United States Patent [19]

Chi

[11] Patent Number: 4,670,068

[45] Date of Patent: Jun. 2, 1987

[54] POLYFUNCTIONAL ISOCYANATE CROSSLINKING AGENTS FOR PROPELLANT BINDERS

[75] Inventor: Minn-Shong Chi, Bel Air, Md.

[73] Assignee: Hercules Incorporated, Wilmington, Del.

[21] Appl. No.: 625,290

[22] Filed: Jun. 27, 1984

Related U.S. Application Data

[63] Continuation of Ser. No. 235,880, Feb. 19, 1981, abandoned.

[51] Int. Cl.[4] ..... C06B 45/10

[52] U.S. Cl. ..... 149/19.4; 149/19.7; 149/19.8

[58] Field of Search ..... 149/19.4, 19.8, 19.9, 149/19.7

[56] References Cited

U.S. PATENT DOCUMENTS

| | | | |
|---|---|---|---|
| 2,855,421 | 10/1958 | Bunge et al. | 260/453 |
| 3,198,677 | 8/1965 | Thomas | 149/19.4 |
| 3,455,883 | 7/1969 | Kamal et al. | 260/77.5 |
| 3,658,763 | 4/1972 | Dehm | 260/77.5 |
| 3,790,416 | 2/1974 | Dehm | 149/19.4 |
| 3,811,967 | 5/1974 | Strickler et al. | 149/19.4 |
| 3,956,890 | 5/1976 | Davis | 60/219 |
| 4,038,115 | 7/1977 | Dehm | 149/19.8 |
| 4,110,135 | 8/1978 | Graham et al. | 149/19.4 |
| 4,154,633 | 5/1979 | Pierce | 149/19.4 |
| 4,158,583 | 6/1979 | Frosch | 149/19.4 |
| 4,165,247 | 8/1979 | Brew et al. | 149/19.4 |
| 4,234,364 | 11/1980 | Robinson | 149/19.4 |
| 4,298,411 | 11/1981 | Godsey | 149/19.4 |

*Primary Examiner*—Edward A. Miller

*Attorney, Agent, or Firm*—Michael B. Keehan

[57] ABSTRACT

A process for preparation of polyfunctional isocyanates having an NCO functionality of at least 4 is provided. The process is conducted at temperatures below 50° C. Polyols having a hydroxyl functionality of at least 4 are reacted with diisocyanates to produce the polyfunctional isocyanates. The ratio of isocyanate groups to hydroxyl groups of the polyol must be at least 4/1. The new polyfunctional isocyanates are particularly useful as crosslinking agents for propellant compositions having a binder containing pendant hydroxyl groups.

6 Claims, No Drawings

POLYFUNCTIONAL ISOCYANATE CROSSLINKING AGENTS FOR PROPELLANT BINDERS

This application is a continuation of application Ser. No. 235,880, filed Feb. 19, 1981, now abandoned.

This invention relates to new polyfunctional isocyanates and to a method for the preparation of such polyfunctional isocyanates. More particularly, this invention relates to crosslinked solid propellants in which the propellant binder reacts with the new polyfunctional isocyanates of this invention to effect, crosslinking thereof.

BACKGROUND OF THE INVENTION

Polyisocyanates and a method for their preparation are disclosed in U.S. Pat. No. 2,855,421. This patent discloses a process in which a polyalcohol such as a dihydric or a mixture of a trihydric alcohol and dihydric alcohol is added to a diisocyanate at a somewhat elevated temperature. The diisocyanate is dissolved in an inert solvent such as ethyl acetate. It is noted that the use of trihydric alcohol should accompany a dihydric alcohol for the conditions employed in U.S. Pat. No. 2,855,421. This patent teaches a ratio of isocyanate groups to hydroxy groups of less than 2/1. If neat trihydric alcohol was used only, then after about 3/4 trihydric alcohol was reacted with diisocyanate, the solution would become very viscous and would eventually gell. One advance of my invention over this patent is based on the ratio of reactants, wherein, the ratio of isocyanate groups groups per hydroxyl group is between 4/1 and 10/1.

SUMMARY OF THE INVENTION

In accordance with this invention, polyfunctional isocyanates having an isocyanate functionality of at least four are provided, said polyfunctional isocyanates being prepared by a process comprising reacting (a) polyol having a hydroxyl functionality of at least four and dissolved in a solvent inert to reaction with said polyol, and (b) a diisocyanate. The ratio of isocyanate groups to hydroxyl groups of the polyol must be at least 4/1 and is preferably 5/1 to about 10/1. The reaction temperature must be maintained below about 50° C. After substantially all of the hydroxyl groups of the polyol have reacted with the diisocyanate, any unreacted diisocyanate and the solvent for the polyol are preferably removed from the reaction products. The product recovered is the polyfunctional isocyanate of this invention.

In preparing the polyfunctional isocyanates of this invention, the reaction of polyol having at least four hydroxyl groups per polyol molecule and diisocyanate is carried out at a temperature from room temperature up to 50° C. The reaction is initiated by addition of a catalyst such as dibutyltin diacetate, dibutyltin dilaurate, triphenyl bismuth and the like to the mixture of polyol and diisocyanate in solvent. The amount of catalyst employed is from about 200 ppm to 500 ppm, based on the weight of the diisocyanate employed. The reaction takes place with the evolution of heat and the total reaction time will vary from about 4 hours to about 6 hours. Since it is an exothermic reaction, the cessation of heat evolution indicates that the reaction is completed. To ensure the completion of reaction, the mixture is stirred at a temperature below 50° C. for 4 to 6 hours after evolution of heat has ceased. After the reaction is complete the excess of the diisocyanate and solvent are distilled off from the reaction mass under high vacuum.

The maximum reaction temperature must be controlled below about 50° C. If the reaction temperature is higher than 50° C., side reactions can occur through the formation of biurete which leads to branching of the polyisocyanate resulting in higher functionality and in extreme cases, gel formation can result.

Illustrative polyols having at least four hydroxyl groups per polyol molecule which can be employed in preparation of the polyfunctional isocyanates of this invention are pentaerythritol, dipentaerythritol, tripentaerythritol, diglycerol, polyvinyl alcohol, and the like. In preparation of the polyfunctional isocyanate, the polyol is dissolved in a solvent. Solvents which can be employed as the reaction medium must be both inert to reaction with the polyol and a solvent for the polyols, such as tetrahydrofuran, dimethylformamide, and dimethylacetamide. Solvents to be used as the reaction medium must be dried to remove substantially all water present in the solvent.

Examples of the diisocyanates which can be employed in the process of this invention include alkyl, cycloalkyl, aryl and alkaryl diisocyanates. Exemplary diisocyanates include hexamethylenediisocyanate, toluenediisocyanate, isophorone diisocyanate, 1,4-cyclohexane dimethylisocyanate, 4,4-diphenylmethane diisocyanate, and 4,4-dicyclohexylmethane diisocyanate, and the like. The foregoing enumeration of diisocyanates which can be employed in the process of this invention is illustrative and not in limitation of diisocyanates that can be employed in the process of this invention.

In the process of preparing the new polyfunctional isocyanates of this invention it is necessary that the mole ratio of diisocyanates to polyol (having a hydroxyl functionality of at least 4) is 4/1 and preferably is from about 5/1 to about 10/1.

In the process of this invention the diisocyanate and polyol react rapidly. The resulting product is preferably a pure compound. Some chain extension always occurs, however, and some diisocyanate remains unreacted. A representative example of the structure of the polyfunctional isocyanates of this invention is set forth below:

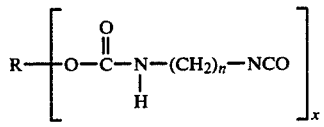

in which:

n is an integer from 3–10, x is an integer of 4 or more,

R is the remaining organic structure from the initial polyol reactant after reaction with diisocyanate.

The polyisocyanates of this invention are particularly useful in crosslinking of polymer having pendant hydroxyl groups that are used as binders in propellant formulations. Crosslinked double base propellants, for example, employ nitrocellulose, polyethylene glycol, mixtures thereof and the like as a binder. These polymers all have pendant hydroxyl groups. Crosslinked double base propellants provide an excellent combination of high impulse density, good mechanical properties and service life for strategic missiles. With current formulations, however, improvements in impulse can be achieved principally through increased solids loading or increased energetic plasticizer concentration, both of which reduce the propellant mechanical integrity and, in particular, propellant toughness. Toughness, as well as other important mechanical properties, is strongly dependent upon the structure of the polymer network comprising the binder for the crosslinked double base propellant system. It has been found that it is possible to prepare crosslinked double base propellant formulations in which increased solids loading or increased energetic plasticizer concentration is achieved without significant reduction in propellant mechanical integrity and toughness. These improved properties are achieved by incorporating within the propellant as a crosslinking agent a polyfunctional isocyanate having a functionality of at least 4, which polyfunctional isocyanate is prepared by the process of this invention. The polyfunctional isocyanate crosslinking agents of this invention are employed in amounts such that the ratio of NCO functionality of the polyfunctional isocyanates to the hydroxyl functionality of the uncrosslinked binder is from about 1/1 to about 1.3/1. In general, the concentration, by weight of polyfunctional isocyanate will be from about 0.5% to about 2.0% by weight, based on the weight of the propellant composition, and preferably from about 0.8% to about 1.5%, based on the weight of the propellant composition.

Examples of preparation of the polyfunctional isocyanates of this invention and of the preparation of crosslinked propellant compositions in which the new crosslinking agents of this invention are employed, follow. In the examples and throughout this specification, percentages are by weight unless otherwise specified.

EXAMPLE 1

The following example illustrates preparation of a polyfunctional isocyanate of this invention from pentaerythritol and hexamethylene diisocyanate.

A 500 ml. flask equipped with a stirrer, thermometer and an addition funnel was charged with 235 grams (1.4 mols) of hexamethylene diisocyanate and 2 drops of dibutyltin diacetate. The solution was stirred and 6.8 grams (0.2 equivalents) of pentaerythritol dissolved in 50 ml. of dimethylformamide was slowly added to the solution resulting in a mildly exothermic reaction. The temperature of the reaction mass was maintained below 50° C. Agitation was continued for 4 hours after evolution of heat could no longer be detected and the temperature was maintained at approximately 22° C. The solvent and the excess hexamethylene diisocyanate were distilled off from the reaction mass under a vacuum of about <0.1 mm. mercury. A viscous, colorless liquid weighing 44 grams was recovered. The equivalent weight of this product was determined by the NCO titration method to be 217. The product was a polyfunctional isocyanate of this invention which contained 0.2% hexamethylene diisocyanate and had an average NCO functionality of 4.5.

EXAMPLE 2

The following example illustrates preparation of a polyfunctional isocyanate of this invention from a tetraol and hexamethylene diisocyanate.

A 500 ml. flask equipped with a stirrer, thermometer and an addition funnel was charged with 252 grams (1 5 mols) of hexamethylene diisocyanate and 2 drops of dibutyltin diacetate. The solution was stirred while 22.5 grams (0.147 equivalents) of Pluracol PEP-650 (a tetraol available commercially from BASF Wyandotte) dissolved in 50 ml. of tetrahydrofuran was added slowly into the solution resulting in a mildly exothermic reaction. The temperature was maintained below 50° C. The mixture was then stirred at room temperature for about 4 hours. After the reaction was complete, as evidenced by no further evolution of heat, the solvent was distilled from the reaction mass at atmospheric pressure and excess hexamethylene diisocyanate was distilled off under a vacuum of <0.1 mm. mercury. A viscous, colorless liquid weighing 47.7 grams was recovered. The equivalent weight of this product was determined by NCO titration to be 327. The product was a polyfunctional isocyanate of this invention which had an average NCO functionality of 4.3. The product contained 5.5% hexamethylene diisocyanate

EXAMPLE 3

The following example illustrates preparation of a polyfunctional isocyanate of this invention from dientaerythritol and hexamethylene diisocyanate.

A 500 ml. flask equipped with a stirrer, thermometer and an addition funnel was charged with 182 grams (1.08 mols) of hexamethylene diisocyanate and 2 drops of dibutyltin diacetate. To this flask was added 4.59 grams (0.108 equivalents) of dipentaerythritol dissolved in 50 ml. dimethylacetamide. A mildly exothermic reaction results. The temperature was maintained below 50° C. during the course of addition and reaction. The resulting mixture was stirred at room temperature for about 4 hours. After the reaction was completed the solvent and excess hexamethylene diisocyanate were distilled off under a vacuum of <0.1 mm. mercury. A viscous, colorless liquid product was recovered weighing 22.8 grams. The equivalent weight of the product was determined to be 178.9 by NCO titration. The product was a polyfunctional isocyanate of this invention having an NCO functionality of greater than 4.0. This product contained less than 3% hexamethylene diisocyanate.

EXAMPLE 4

The following example illustrates preparation of a polyfunctional isocyanate of this invention from tripentaerythritol and hexamethylene diisocyanate.

To a 500 ml. flask equipped with a stirrer, thermometer and an addition funnel was charged with 178 grams (1.05 mols) of hexamethylene diisocyanate and 2 drops of dibutyltin diacetate. To this mixture was slowly added 4.9 grams (0.105 equivalents) of tripentaerythritol dissolved in 50 ml. of dimethylformamide. A reaction took place which was mildly exothermic. Temperature is maintained below 50° C. Agitation of the reaction mass was continued for 5 hours while the temperature was maintained between 25° C. and 40° C. The solvent and excess hexamethylene diisocyanate were distilled off under a vacuum of <0.1 mm. mercury. A viscous, colorless liquid was recovered weighing 22.54 grams. The equivalent weight of this product was determined to be 194 by NCO titration. The product was a polyfunctional isocyanate of this invention that had an average isocyanate functionality of greater that four. The product contained 17.5% hexamethylene diisocyanate

EXAMPLES 5–8

Propellant mixes were prepared employing both the polyfunctional isocyanate compositions of this invention (Examples 1–4) and a polyfunctional isocyanate composition commercially available which was used for control purposes. The propellants were prepared in a one-pound mixer following conventional propellant mixing techniques. The binder prepolymer, nitroglycerin and thermal stabilizer were placed in a mixer at 60° C. and mixed until the solution became homogeneous (about 15 minutes). Auxiliary fuel was added to the mixture and then ½ of the total oxidizer was added. After mixing for 10 minutes, ¼ of total oxidizer was added and mixed well for about 5 minutes. Then the final ¼ of the total oxidizer was added and mixed for another 30 minutes. After the mixer was cooled down to 50° C., the cure catalyst and then the crosslinking agent were added to the resulting slurry. The slurry was mixed for 30 minutes and cast into a polyethylene box and cured at 60° C. for 7 days. The polyfunctional isocyanates of Examples 1–4 were used in preparation of propellant compositions without purification, i.e., with any HDI being included in computing the curative stoichiometry (NCO/OH). The effect of excess HDI in the polyfunctional isocyanate is to reduce the value of the average functionality of the polyfunctional isocyanate by an amount proportional to its content of HDI. The propellant compositions, including the control propellants, have the composition set forth in Table I. The molecular weight of the polyethylene glycol (PEG) used in these compositions varied and the molecular weights of the various polyethylene glycols employed are reported in Table II.

TABLE I

| Ingredients | Weight % |
|---|---|
| Polyethylene glycol (PEG) | 6.78 |
| Nitroglycerin | 16.41 |
| Thermal Stabilizer | 0.52 |
| Cure Catalyst | 0.04 |
| Auxiliary Fuel (solids) | 17.00 |
| Oxidizers (solids) | 58.00 |
| Polyfunctional Isocyanate* | 1.29 |

*NCO/OH = 1.2/1.0

Following mixing of the propellant, the propellant was cast and cured at a temperature of 60° C. for 7 days. Following curing, propellant samples were prepared from the propellant and mechanical properties of the propellant were evaluated. The results of this evaluation are set forth in Table II.

TABLE II

| Example | Mol. Wt. PEG | Poly-functional Isocyanate | Pl/Po** | Stress $\sigma$ (psi) | Strain $\epsilon_m/\epsilon_b$ (%) | Modulus $E_o$ (psi) |
|---|---|---|---|---|---|---|
| 5 | 7634 | Ex. 1 | 2.1 | 66 | 277 | 506 |
| 6 | 7634 | Ex. 2 | 2.1 | 64 | 400 | 389 |
| 7 | 3144 | Ex. 3 | 2.1 | 74 | 25/47 | 752 |
| 8 | 3144 | Ex. 4 | 2.1 | 73 | 28 | 711 |
| Control 1 | 7634 | N-100* | 2.1 | 84 | 915 | 290 |
| Control 2 | 3144 | N-100* | 2.1 | 64 | 35/104 | 615 |

*Desmodur N-100 is a polyfunctional isocyanate having an average isocyanate functionality of about 3.5 and is available commercially from Mobay Chemical Company.

**Ratio by weight of plasticizer (energetic) to polymer (polyethylene glycol and crosslinking agent).

$\epsilon_m$ = elongation at maximum stress $\sigma_m$ $\epsilon_b$ = strain or elongation at break The propellant compositions which can be crosslinked with the new polyfunctional isocyanate compositions or this invention are prepared by the crosslinking of propellant binders (sometimes referred to as binder prepolymer) having pendant hydroxyl groups. Polyethylene glycol (PEG) was used as a binder prepolymer for the binder formation in the examples. However, other binder prepolymers having pendant hydroxyl groups such as polyglycol adipate (PGA), Tetracol TE (a copolymer of tetrahydrofuran with ethylene glycol and available commercially from E. I. du Pont de Nemours & Company), hydroxy terminated poly(1,6-hexandiol adipate phthalate) (HDAP), and hydroxy terminated polybutadiene with or without crosslinking aids such as nitrocellulose and cellulose acetate butyrate, may be employed.

Small amounts of nitrocellulose can be employed with the polyfunctional isocyanate compositions of this invention as auxiliary crosslinking agents and such nitrocellulose is employed in amounts of from about 0.15% to about 0.25% by weight, based on the weight of the propellant composition.

EXAMPLES 9–16

The following propellants were prepared using the method of preparation generally described for the propellant compositions of Examples 5–8. These propellant compositions were comprised of 16.41% nitroglycerin, 0.52% thermal stabilizer, 17% auxiliary fuels, 6.78% binder prepolymer, 1.29% polyfunctional isocyanate crosslinking agent, 0.04% curing catalyst. The NCO/OH ratio was 1.2/1.0.

The resulting propellants were evaluated for mechanical properties. The result of these tests are set forth in Table III below.

TABLE III

| Example | Prepolymer | Mol. Weight | Cross-linker | Pl/Po[1] | Viscosity Kp EOM[2] | Stress $\sigma_m$ (psi) | Strain $\epsilon_m/\epsilon_b$ (%) | Modulus $E_o$ (psi) |
|---|---|---|---|---|---|---|---|---|
| 9 | Blend CW-4000[3] CW-6000[4] | 6138 | Ex. 1 | 2.1 | 6.7 | 68 | 239 | 558 |
| 10 | Blend CW-4000[3] CW-6000[4] | 6138 | N-100 | 2.1 | 6.2 | 75 | 564 | 260 |
| 11 | Pluronic F88[5] | 9428 | Ex. 1 | 2.1 | 8.0 | 80 | 411 | 381 |
| 12 | Pluronic F98[5] | 13170 | Ex. 1 | 2.1 | 7.3 | 79 | 503 | 210 |
| 13 | CW-6000[4]/NC (5 sec)[6] | 7634 | Ex. 1 | 2.8 | 7.6 | 101 | 179 | 526 |
| 14 | CW-6000[4]/NC (5 sec)[6] | 7634 | Ex. 2 | 2.5 | 10.2 | 96 | 147 | 486 |
| Control No. 3 | CW-6000[4]/NC (5 sec)[6] | 7634 | N-100 | 2.8 | 16.9 | 96 | 250 | 359 |
| 15 | CW-6000[4]/CAB[7] | 7634 | Ex. 1 | 2.8 | 8.8 | 74 | 24/160 | 590 |
| 16 | CW-6000[4]/CAB[7] | 7634 | Ex. 2 | 2.8 | 13.5 | 74 | 24/87 | 655 |
| Control | CW-6000[4]/CAB[7] | 7634 | N-100 | 2.8 | 13.6 | 62 | 440 | 380 |

TABLE III-continued

| Example | Prepolymer | Mol. Weight | Cross-linker | Pl/Po[1] | Viscosity Kp EOM[2] | Stress $\sigma_m$ (psi) | Strain $\epsilon_m/\epsilon_b$ (%) | Modulus $E_o$ (psi) |
|---|---|---|---|---|---|---|---|---|
| No. 4 | | | | | | | | |

[1]Plasticizer/polymer weight ratio (Pl/Po).
[2]EOM = End of Mix.
[3]CW-4000 (Polyethylene glycol Mol. Wt. 3144, available commercially from Union Carbide).
[4]CW-6000 (Polyethylene glycol Mol. Wt. 7634, available commercially from Union Carbide).
[5]80% Polyethylene glycol and 20% polypropylene oxide having a functionality of 2 (available commercially from BASF Wyandotte).
[6]Nitrocellulose (NC 5 sec.), NC to PEG weight ratio is 0.03.
[7]Cellulose acetate butyrate; CAB to PEG weight ratio is 0.03.

The polyfunctional isocyanates of this invention when used as crosslinking agents for the binder systems when compared to the control crosslinking agents (N-100) resulted in propellant compositions having higher modulus while maintaining stress and strain levels in all cases. As illustrated in Table III, when high molecular weight polyethylene glycol, i.e., having a molecular weight of greater than 6,000 was employed as a binder prepolymer and was cured with polyisocyanate of the prior art (N-100), a modulus of 260 p.s.i. was obtained for the resulting propellant (Example 10). When polyethylene glycol having the same molecular weight was cured with a polyfunctional isocyanate of this invention, a modulus of 558 p.s.i. was obtained for the resulting propellant (Example 9).

When the medium range molecular weight polyethylene glycol having a modecular weight of about 3,144 was employed as a binder prepolymer and was cured with N-100, the resulting propellant exhibited a modulus of 615 p.s.i. and a low strain of 35%, see control 2 in Table II. This data illustrates the problem of maintaining acceptable mechanical properties employing certain polyisocyanates as a crosslinking agent for propellant binders.

The propellant composition of Example 5, which was crosslinked using polyfunctional isocyanates of this invention prepared from pentaerythritol and hexamethylene diisocyanate has acceptable mechanical properties with a modulus of 506 p.s.i. and a strain of 277%. The higher functionality polyfunctional isocyanates of this invention permit the use of higher molecular weight polyethylene glycol while achieving acceptable mechanical properties in the propellants that are cured with such polyisocyanates.

Tactical and strategic propellants require high performance. In order to achieve high performance with current formulations, high plasticizer content and/or high solids loading will be required. As shown in Table III, propellants crosslinked with the polyfunctional isocyanate of this invention, i.e., Example 13, exhibit improved mechanical properties at the same plasticizer to polymer ratio and solids loading, (see Examples 13 and 14), as compared to a control propellant composition employing the prior art polyisocyanate and nitrocellulose crosslinkers, see control 3, Table III. Comparison of the data shows the tensile strengths of these three mixes are about the same and the elongations are satisfactory. However, the modulus of the propellant of control 3 is substantially lower than the modulus of the propellant of Examples 13 and 14. Thus, it is concluded that the use of the crosslinking agents of this invention to crosslink the binder prepolymer in composite propellants will allow the use of higher levels of plasticizer and higher solids loading with the possibility of still achieving satisfactory mechanical properties. The propellants of Examples 15 and 16 which are cured using the polyisocyanates of this invention also exhibit improved mechanical properties over those of the propellant composition described as control 4.

What I claim and desire to protect by Letters Patent is:

1. In a propellant composition comprising a binder prepolymer having pendant hydroxyl groups, an auxiliary crosslinking agent comprising nitrocellulose, an energetic plasticizer, oxidizer solids selected from inorganic and organic materials, a crosslinxing agent for said binder prepolymer and a curing catalyst for said propellant composition, the improvement comprising as the crosslinking agent a polyfunctional isocyanate composition having an average isocyanate functionality of at least 4, said polyfunctional isocyanate being made by a process comprising reacting (a) a polyol having a hydroxyl functionality of at least 4 dissolved in a solvent inert to reaction witn said polyol, and (b) a diisocyanate, at a temperature of from about room temperature (22° C.) to below about 50° C. forming a reaction mass, the initial ratio of isocyanate groups of the diisocyanate to the hydroxyl groups of the polyol being at least 4/1, said reaction being continued until substantially all of hydroxyl groups of the polyol in the reaction mass have reacted with the isocyanate groups of the diisocyanate and recovering polyfunctional isocyanates having an average isocyanate functionality of at least 4.

2. In a propellant composition comprising a binder prepolymer having pendant hydroxyl groups, a crosslinking aid comprising cellulose acetate butyrate, an energetic plasticizer, oxidizer solids selected from inorganic and organic materials, a crosslinking agent for said binder prepolymer and a curing catalyst for said propellant composition, the improvement comprising as the crosslinking agent a polyfunctional isocyanate composition having an average isocyanate functionality of at least 4, said polyfunctional isocyanate being made by a process comprising reacting (a) a polyol having a hydroxyl functionality of at least 4 dissolved in a solvent inert to reaction witn said polyol, and (b) a diisocyanate, at a temperature of from about room temperature (22° C.) to below about 50° C. forming a reaction mass, the initial ratio of isocyanate groups of the diisocyanate to the hydroxyl groups of the polyol being at least 4/1, said reaction being continued until substantially all of hydroxyl groups of the polyol in the reaction mass have reacted with the isocyanate groups of the diisocyanate and recovering polyfunctional isocyanates having an average isocyanate functionality of at least 4.

3. The propellant of claim 1 in which the binder prepolymer comprises polyetnylene glycol having a molecular weignt of from about 3,144 to about 7,634 and the polyfunctional isocyanate is prepared by reaction of pentaerythritol and hexamethylenediisocyanate.

4. The propellant of claim 1 in which the polyfunctional isocyanate is prepared by reaction of a tetraol and hexamethylene diisocyanate.

5. The propellant of claim 1 in which polyfunctional isocyanate is prepared by reaction of dipentaerythritol and hexamethylene diisocyanate.

6. The propellant of claim 1 in which the nitrocellulose is 5 sec Nitrocellulose (solution viscosity).

* * * * *

UNITED STATES PATENT AND TRADEMARK OFFICE

CERTIFICATE OF CORRECTION

PATENT NO. 4,670,068
DATED June 2, 1987
INVENTOR(S) Minn-Shong Chi 1

It is certified that error appears in the above-identified patent and that said Letters Patent is hereby corrected as shown below:

Column 3, line 67 "grams (1 5 mols)"

should read -- grams (1.5 mols) --

Column 4, lines 24-25"dientaerythritol"

should read -- dipentaerythritol --

Signed and Sealed this

Third Day of November, 1987

*Attest:*

*Attesting Officer*

DONALD J. QUIGG

*Commissioner of Patents and Trademarks*